US006181360B1

(12) United States Patent
Shirakawa et al.

(10) Patent No.: US 6,181,360 B1
(45) **Date of Patent: *Jan. 30, 2001**

(54) THERMAL HEAD

(75) Inventors: Takashi Shirakawa; Toshifumi Nakatani, both of Iwate-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/164,071

(22) Filed: Sep. 30, 1998

(30) Foreign Application Priority Data

Oct. 3, 1997 (JP) ..... 9-287767

(51) Int. Cl.[7] ..... B41J 2/335
(52) U.S. Cl. ..... 347/202
(58) Field of Search ..... 347/200, 202

(56) References Cited

U.S. PATENT DOCUMENTS 5,473,357 * 12/1995 Shirakawa et al. ..... 347/202
5,661,513 * 8/1997 Shirakawa et al. ..... 347/202

FOREIGN PATENT DOCUMENTS 4-270187 * 9/1992 (JP) ..... 347/202
6-106755 4/1994 (JP) .
7-329330 12/1995 (JP) .

* cited by examiner

*Primary Examiner*—Huan Tran
(74) *Attorney, Agent, or Firm*—Brinks Hofer Gilson & Lione

(57) ABSTRACT

The present invention provides a thermal head in which the surface of a heat insulating layer formed by vapor deposition such as sputtering or the like is polished to decrease the rate of defects such as failure in the resistance values of heating elements formed on the heat insulating layer, disconnection and short-circuit of electrodes, apparent foreign materials, etc., and improve the adhesion of the surface of the heat insulating layer. The thermal head includes a heat insulating layer formed on a radiating substrate by sputtering, and heating elements deposited on the surface of the thermal head, wherein the heat insulating layer has columnar crystals composed of silicon, transition metals and oxygen, the surface of the heat insulating layer is polished, and micro irregularity is formed on the polished surface of the heat insulating layer.

10 Claims, 6 Drawing Sheets

(3 of 6 Drawing Sheet(s) Filed in Color)

THERMAL HEAD

BACKGROUND OF THE INVENTION

1. Field of the Invention

The present invention relates to a thermal head used for a thermal printer, and particularly to a thermal head comprising a heat insulating layer formed by vapor deposition such as sputtering in order to improve the printing life, wherein the surface of the heat insulating layer is polished.

2. Description of the Related Art

A conventional thermal head comprises a heat insulating layer formed on a heat radiating substrate by vapor deposition such as sputtering or the like, and a plurality of heating elements linearly arranged on the heat insulating layer so that current is selectively passed through the heating elements to record a dot image using heat sensitive recording paper or a heat transfer ribbon.

In the example shown in FIG. 5, the thermal head comprises a heat insulating layer 12 formed, by sputtering, in a thickness of about 20 $\mu$m on a substrate 11 of silicon having excellent radiating property, composed of silicon, transition metals and oxygen, and having excellent heat resistance. In the process for depositing the heat insulating layer 12, the sputtering pressure is as high as about 1.0 Pa in order to intentionally form columnar crystals and deposit the layer with a low density, to obtain the heat insulating layer 12 having excellent heat insulating property.

However, since the heat insulating layer 12 comprises columnar crystals, the surface thereof exhibits a rough state having initial irregularity 12*a*. Also abnormal projections 12*b* occur due to contaminant particles peculiar to the vapor deposition process. The contaminant particles represent particles produced by peeling of a film deposited in the vacuum container of a vapor deposition apparatus such as a sputtering apparatus or the like, and floating as particles having a size of 0.1 to several micrometers in the vacuum container. In film deposition, the contaminant particles adhere to the substrate surface to produce projections in the film formed on the substrate surface with the contaminant particles as nuclei.

FIG. 6 is a drawing showing a three-dimensional image of the surface of the heat insulating layer 12, which was output by using an atomic force microprobe AFM. As the result of measurement of the surface roughness (Rz), Rz=45 nm.

Although not shown in the drawings, on the heat insulating layer 12 are formed a heating resistor, and a common electrode and individual electrodes for passing a current through the heating resistor. A protecting layer is further coated for protecting the heating resistor and each of the electrodes from oxidation and abrasion to form a thermal head.

The heat insulating layer 12 comprising columnar crystals and formed by sputtering as described above has a high degree of defects such as variations in the dot resistance value, disconnection and short-circuit of the electrode pattern, apparent foreign materials, etc. due to the initial irregularity 12*a* and the abnormal projections 12*b* formed with the contaminant particles peculiar to the vapor deposition process as nuclei, and thus has the problem of deteriorating the product quality and production yield.

Therefore, the applicant already proposed that the initial irregularity 12*a* peculiar to the columnar crystals on the surface of the heat insulating layer 12, and the macroscopic abnormal projections 12*b* formed with the contaminant particles as nuclei are removed by chemical polishing to form substantially a mirror surface, thereby solving the problem of deteriorating product quality and production yield. FIG. 3 is a schematic drawing showing the surface of the heat insulating layer after chemical polishing. In FIG. 3, reference numerals 12*a* and 12*b* denote portions corresponding to the initial irregularity and abnormal projections, respectively, shown in FIG. 5.

FIG. 4 is a drawing showing a three-dimensional image of the surface of the heat insulating layer 12 after polishing, which was output by the atomic force microprobe AFM. In this case, the surface is a smooth surface having less irregularity and a surface roughness Rz=4.5 nm.

However, as a result of a printing durability test of the thermal head comprising the heating elements formed on the heat insulating layer 12 chemically polished to substantially a mirror surface, the actual printing life was about 20,000,000 to 50,000,000 characters. This was due to a trouble mode in which, in printing runs, the protecting layer is cracked due to deterioration in adhesion of the films in the upper and lower interfaces of the heating resistor formed on the heat insulating layer 12, thereby causing dot defects due to oxidation of the heating resistor. This was caused by the excessive flatness of the surface of the heat insulating layer 12 as a base, and it was thus found that the surface must be modified to increase the adhesion.

In recent years, mass production of thermal heads comprising a silicon substrate with excellent heat responsiveness in order to improve printing quality has been made, and the contact pressure between a thermal head and a printing medium (a heat transfer ribbon or heat sensitive paper) has been increased in order to improve printing quality for plain paper. Therefore, in a printing operation, high shearing stress is applied to the thermal head, as compared with previous thermal heads. The shearing stress causes peeling due to fatigue failure in the upper and lower interfaces of the heating resistor, thereby interfering with an increase in the printing life.

SUMMARY OF THE INVENTION

It is an object of the present invention to provide a thermal head comprising a heat insulating layer formed by a vapor deposition method such as sputtering or the like, and having a polished surface so that the heat insulating layer is the best as a base for forming heating elements.

It is another object of the present invention to provide a thermal head in which the adhesion of the polished surface of a heat insulating layer can be improved without increases in the rate of defects such as failure in the resistance values of heating elements, disconnection and short-circuit of electrodes, apparent foreign materials, etc.

A thermal head of the present invention comprises a heat insulating layer formed on a radiating substrate by a vapor deposition method such as sputtering or the like, and heating elements deposited on the polished surface of the heat insulating layer, wherein the heat insulating layer comprises columnar crystals composed of silicon, transition metals and oxygen, the surface of the heat insulating layer is polished, and micro irregularity is formed on the polished surface of the heat insulating layer.

It is a further object of the present invention to increase the surface area of the heat insulating layer by utilizing the above construction without causing surface roughness of the heat insulating layer.

In the thermal head of the present invention, the micro irregularity is formed by selectively removing silicon-oxygen bond texture portions which are scattered in the heat insulating layer.

It is a further object of the present invention to uniformly form micro irregularity over the entire surface of the heat insulating layer by utilizing the above construction.

BRIEF DESCRIPTION OF THE DRAWINGS

The file of this patent contains at least three drawings executed in color. Copies of this patent with color drawings will be provided by the Patent and Trademark Office upon request and payment of the necessary fee.

DESCRIPTION OF THE PREFERRED EMBODIMENT

Figure 1:
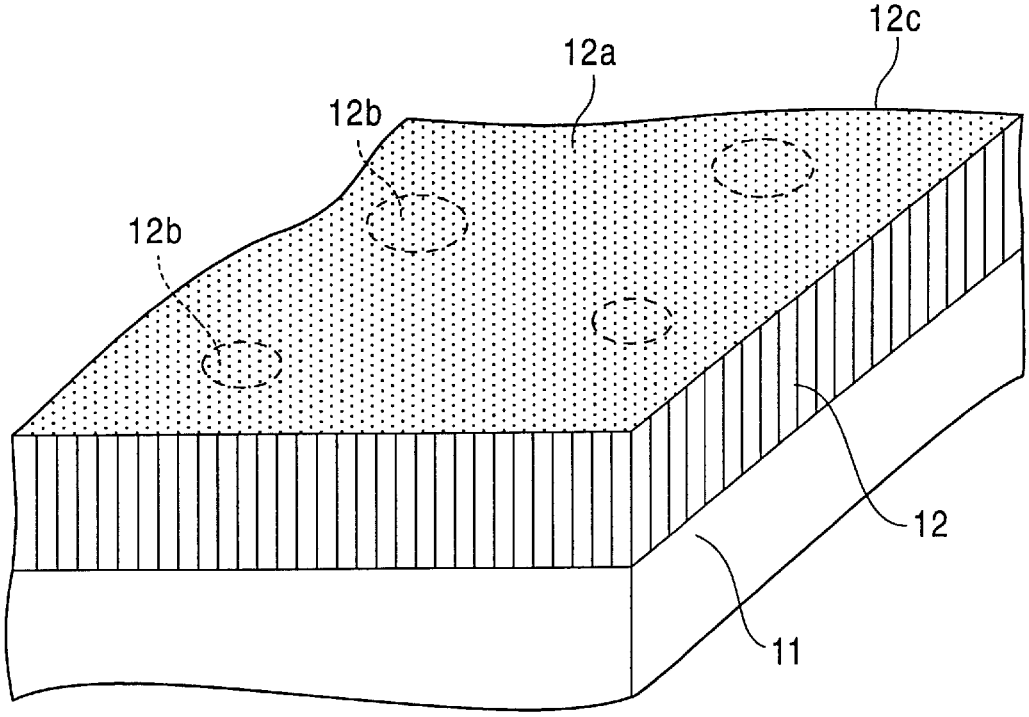
FIG. 1 is a schematic drawing showing the state of a heat insulating layer of a thermal head of the present invention.
Figure 2:
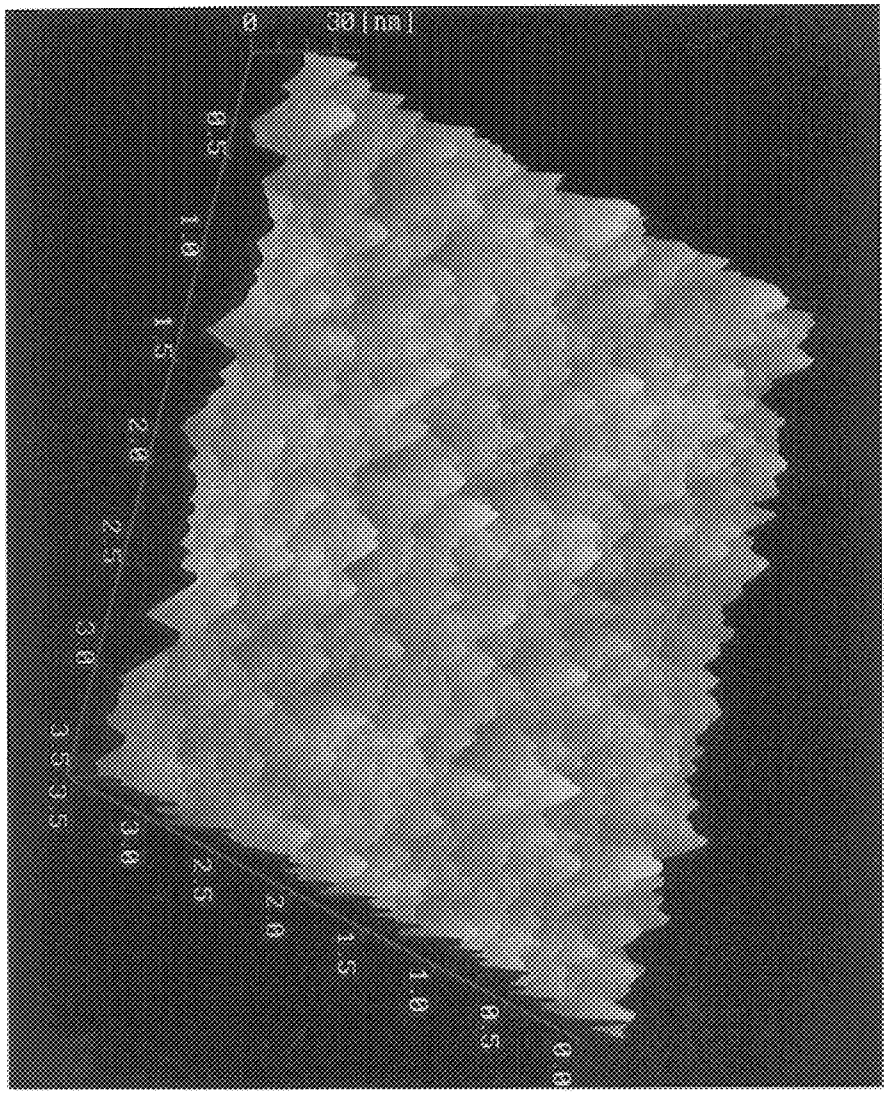
FIG. 2 is a photograph of a three-dimensional image of the heat insulating layer shown in FIG. 1, which was output by an atomic force microprobe AFM.

An embodiment of the present invention is described with reference to FIGS. 1 and 2. FIG. 1 is a schematic drawing showing the state of a heat insulating layer of a thermal head of this embodiment, and FIG. 2 is a photograph of a three-dimensional image of the heat insulating layer, which was output by an atomic force microprobe AFM. In FIGS. 1 and 2, the same members as the conventional example are denoted by the same reference numerals.

Figure 5:
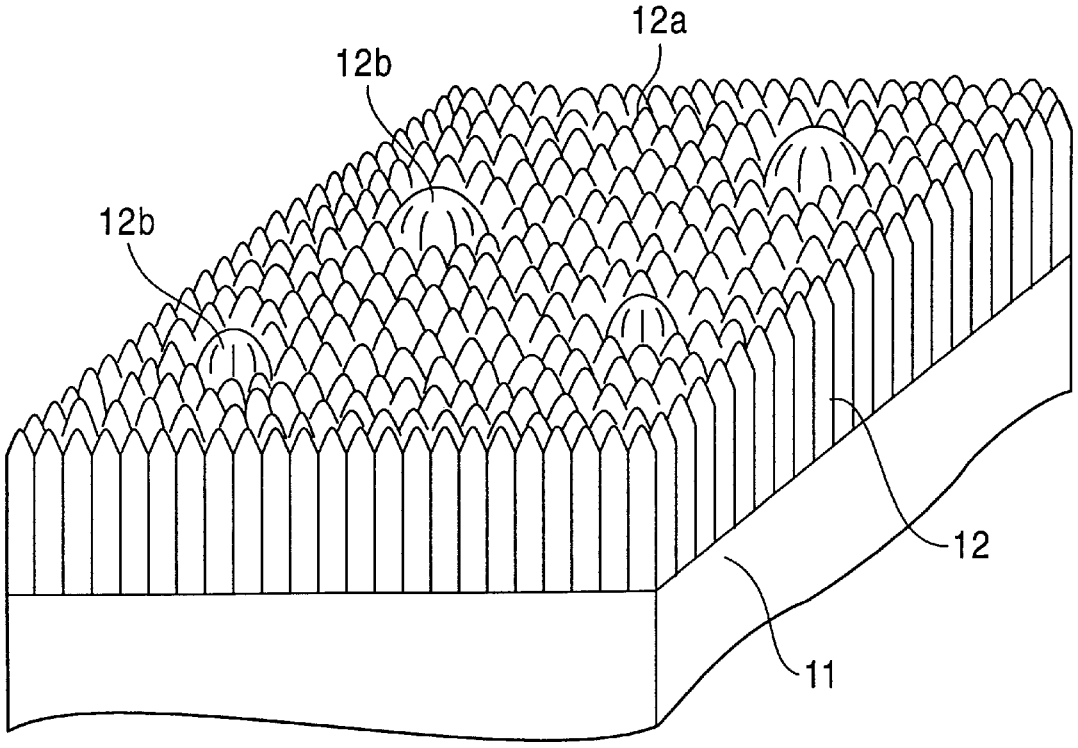
FIG. 5 PRIOR ART
FIG. 5 is a schematic drawing showing the deposition state of a heat insulating layer of a conventional thermal head.
Figure 6:
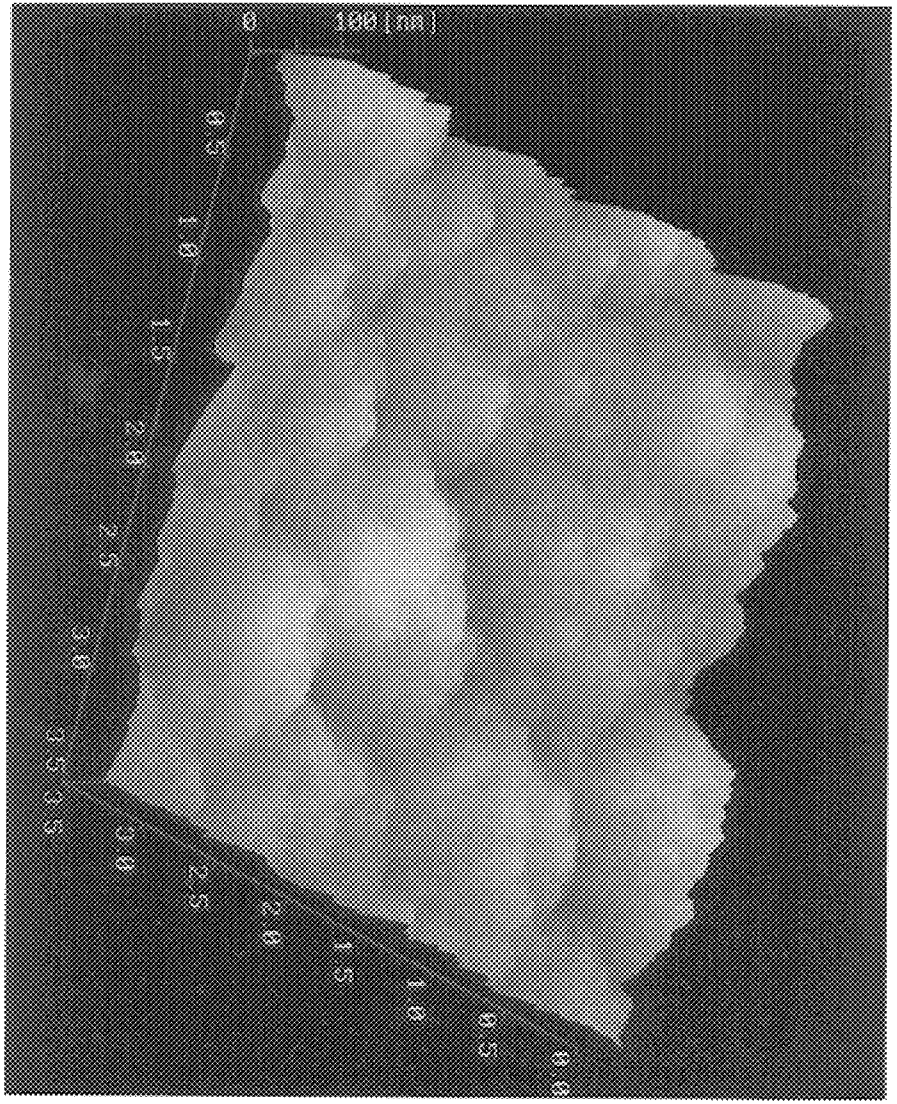
FIG. 6 PRIOR ART
FIG. 6 is a photograph of a three-dimensional image of the heat insulating layer shown in FIG. 5, which was output by an atomic force microprobe AFM.

In the thermal head of this embodiment, in step 1 of forming the heat insulating layer, the heat insulating layer 12 is formed by, vapor deposition, in a thickness of about 20 $\mu$m on the silicon substrate 11 to form a state equivalent to the heat insulating layer 12 of the conventional example shown in FIG. 5.

The heat insulating layer 12 is composed of silicon, transition metals and oxygen, e.g., multiple elements such as Si-Ta-W-Cr-O, or the like, and deposited on the silicon substrate 11 by sputtering at a deposition pressure of as high as about 1.0 Pa to form columnar crystals at a low density. Therefore, the heat insulating layer 12 has excellent heat insulating property. In this embodiment, preferred transition metals are not limited to Ta, W and Cr. and other transition metals such as Mo, Ti, Zr, Nb, Hf, and the like can be used.

In this state, the heat insulating layer 12 has a surface having the initial irregularity 12*a* and the macroscopic abnormal projections 12*b* due to contaminant particles peculiar to the vapor deposition process, as in the conventional example shown in FIG. 5.

Figure 3:
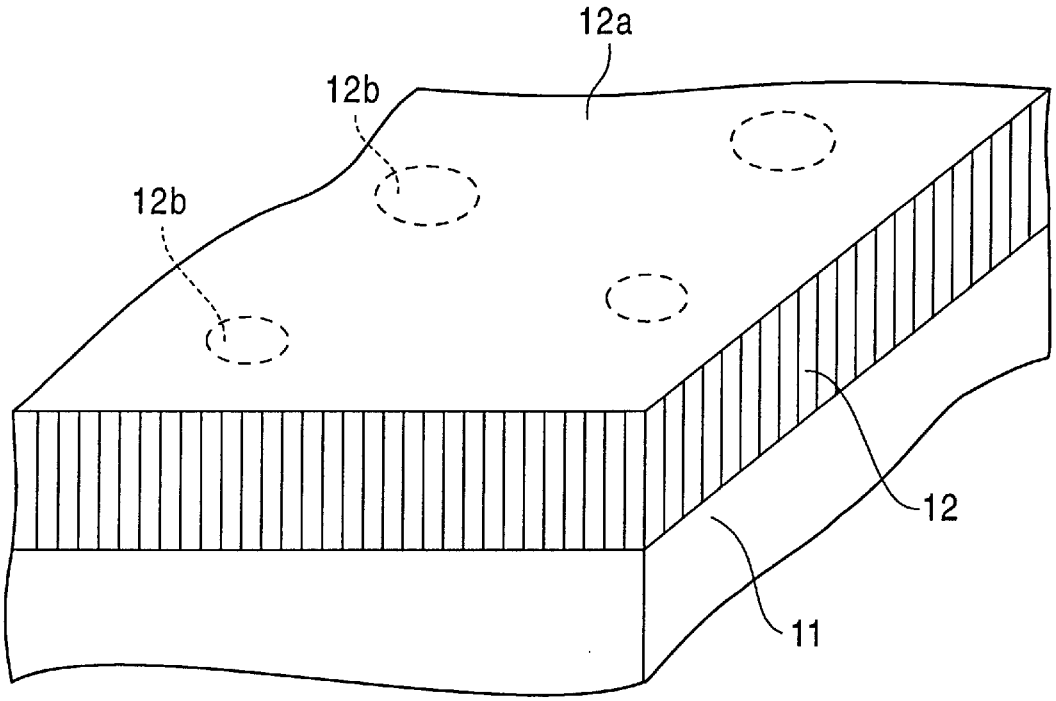
FIG. 3 PRIOR ART
FIG. 3 is a schematic drawing showing the polished state of a heat insulating layer of a conventional thermal head.
Figure 4:
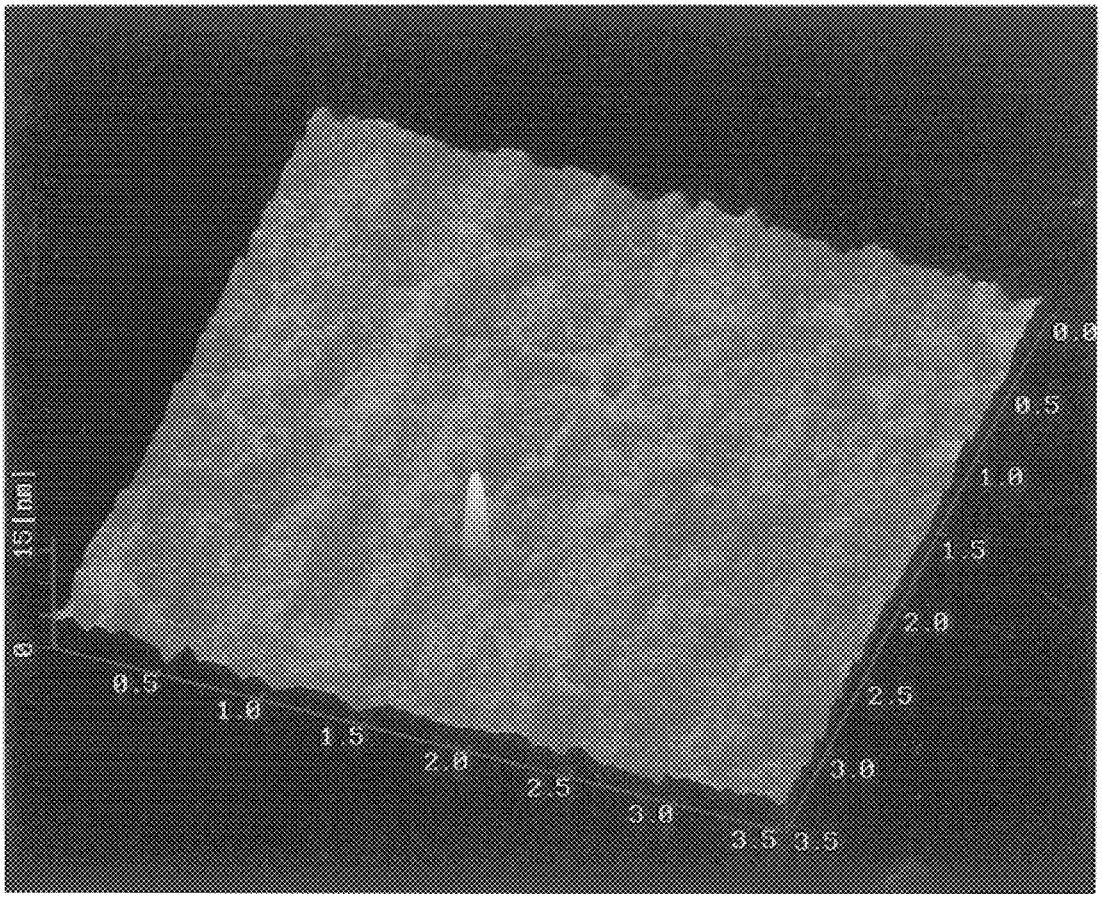
FIG. 4 PRIOR ART
FIG. 4 is a photograph of a three-dimensional image of the heat insulating layer shown in FIG. 3, which was output by an atomic force microprobe AFM.

In step 2 of forming the heat insulating layer, the surface of the heat insulating layer 12 is polished by a polishing device (not shown) using a polishing cloth containing an alkaline chemical polishing solution in which amorphous silica ($SiO_2$) fine powder as a abrasive material is dispersed to form a state equivalent to the polished heat insulating layer shown in FIG. 3. As an example of the chemical polishing solution, Trade Name "48-211 Polish-Ade 0.06 $\mu$m" produced by Refine Tec, Ltd. and comprising 40 to 41 wt % of amorphous silica fine powder having an average particle diameter of 0.06 $\mu$m, 0.11 wt % or less of $Na_2O$, and water as the balance was used.

In this chemical polishing, the material of the heat insulating layer 12 is subjected to the strong chemical polishing actions of the abrasive material and the alkaline chemical polishing solution to efficiently remove both the initial irregularity 12*a* due to the columnar crystals and the macroscopic abnormal projections 12*b* due to contaminant particles of the vapor deposition process. It is thus possible to easily make the surface of the heat insulating layer 12 substantially a mirror surface.

In step 3 of forming the heat insulating layer, after the surface of the heat insulating layer 12 is chemically polished to substantially a mirror surface, the surface of the heat insulating layer 12 is immersed in a buffered hydrofluoric acid solution for about 30 to 90 seconds to selectively dissolve and remove Si-O bond structure portions in the heat insulating layer 12 composed of multiple elements such as Si-Ta-W-Cr-O, or the like, to form uniform micro irregularity 12*c*. As an example of the buffered hydrofluoric acid solution, Trade Name "Semiconductor BUFFERED HYDROFLUORIC ACID 63U1" produced by Daikin Industries, Ltd., and comprising 6 wt % of HF, 30 wt % of $NH_4F$, and water as the balance was used.

The time of etching with the buffered hydrofluoric acid solution is preferably in the range of about 20 to 100 seconds, and an etching time of over 100 seconds has the problem of deteriorating mechanical strength due to the excessive porosity of the surface of the heat insulating layer 12. With an etching time of less than 20 seconds, the micro irregularity 12*c* cannot be effectively formed. Therefore, the etching time is more preferably in the range of about 30 to 90 seconds.

FIG. 2 shows the surface of the heat insulating layer after etching with the buffered hydrofluoric acid solution for 60 seconds. FIG. 2 indicates that the surface has a surface roughness Rz=25 nm, and uniform micro irregularity, as compared with the surface before polishing.

Table 1 shows comparison between the surface states (the height of projections, the diameter of the bottom of projections, and the number of projections) of the heat insulating layer 12 in the respective steps.

TABLE 1

| | Comparison of surface states of heat insulating layer | | | |
|---|---|---|---|---|
| Step | Surface | Height of projection (nm) | Diameter of bottom of projection ($\mu$m) | Number of projections (per 3.5-$\mu$m square) |
| Step 1 before polishing | Abnormal projection | 40–80 | 0.5–1.0 | 50–10 |
| Step 2 after polishing | Polished surface | 3–5 | 0.1 or less | 1000 or more |
| Step 3 after etching | Micro irregularity | 10–30 | 0.2–0.3 | 300–100 |

Although not shown in the drawings, a heating resistor made of Ta-$SiO_2$ or the like is deposited, by sputtering or the like, on the etched surface of the heat insulating layer, and then etched by photolithography to form a plurality of heating elements.

On the upper side of these heating elements is deposited a common electrode connected to the heating elements, and on the other side of the heating elements are deposited independent electrodes for independently passing a current through the heating elements. The common electrode and the independent electrodes are made of, for example, Al, Cu, or the like, and are formed by vapor deposition such as sputtering or the like, and then etching in a desired pattern.

On the heating elements, the common electrode, and the independent electrodes is coated, by sputtering or the like, a protecting layer having a thickness of about 5 to 10 $\mu$m, for protecting the heating elements and each of the electrodes.

In the thermal head of this embodiment produced by the above method, the heat insulating layer 12 comprising columnar crystals composed of materials of silicon, transition metals and oxygen is formed by vapor deposition, and the surface of the heat insulating layer 12 is then chemically polished by the alkaline chemical polishing solution containing the abrasive material dispersed therein to efficiently remove the initial irregularity 12*a* and the abnormal projections 12*b* of the surface, to form substantially a mirror surface. Then the polished surface of the heat insulating layer 12 is etched with the buffered hydrofluoric acid solution for about 60 seconds to form micro irregularity 12*c* having excellent uniformity on the surface of the heat insulating layer 12. As a result, the adhesion of the heating resistor can be improved by an increase in the surface area of the heat insulating layer 12 and the wedge effect of the film formed on the heat insulating layer 12 while maintaining the pattern formation precision of heating dots.

As a result of the printing durability test of the thermal head of the present invention, the printing life was printing of 50,000,000 to 80,000,000 characters. It was thus found that the printing life can be increased to about twice the life of a conventional thermal head.

The present invention is not limited to this embodiment, and various changes can be made by using, for example, dry etching with carbon fluoride gas as an etchant in place of buffered hydrofluoric acid according to demand.

As described above, the thermal head of the present invention has the effects below.

Since the abnormal projections peculiar to vapor deposition produced on the surface of the heat insulating layer are removed by chemical polishing, and then surface is etched to form micro irregularity, the surface area of the heat insulating layer can be increased without causing surface roughness of the heat insulating layer. It is thus possible to improve the adhesion of the deposited film such as the heating resistor or the like formed on the heat insulating layer without increasing the rate of defects such as disconnection and short-circuit of the electrodes, and apparent foreign materials while decreasing the variation of the resistance value and maintaining the pattern formation precision of the heating elements. The present invention thus exhibits the effect of improving the printing life of the thermal head.

Since the micro irregularity is formed by selectively removing the silicon-oxygen bond portions scattered in the texture of the heat insulating layer, the micro irregularity is uniformly formed over the entire surface of the heat insulating layer. As a result, the adhesion of the deposited film such as the heating resistor or the like formed on the heat insulating layer can be improved while keeping down the variations of the resistance values of a plurality of heating elements. Therefore, the present invention exhibits the effect of forming a thermal head capable of improving printing quality, and increasing the printing life of the thermal head.

Furthermore, the heat insulating layer is formed by sputtering, and the surface thereof is polished with the chemical polishing solution containing the abrasive material dispersed therein to remove the abnormal projections produced on the surface of the heat insulating layer, and then etched with the buffered hydrofluoric acid solution to form micro irregularity. It is thus possible to produce the heat insulating layer with high material and thickness precision, and form micro irregularity over the entire surface of the heat insulating layer with high reproducibility. The present invention thus exhibits the effect of improving product quality and production yield.

Since the time of etching with the buffered hydrofluoric acid solution is set to 30 to 90 seconds, it is possible to effectively form micro irregularity on the surface of the heat insulating layer, and form appropriate micro irregularity over the entire surface of the heat insulating layer without deteriorating the mechanical strength of the surface of the heat insulating layer. The present invention thus exhibits the effect of improving product quality and production yield.

What is claimed is:

1. A thermal head comprising a heat insulating layer formed on a radiating substrate, and a plurality of heating elements arrayed on the surface of the heat insulating layer, each of said plurality of heating elements being selectively energized and heated for performing recording of a dot image, wherein the heat insulating layer comprises columnar crystals composed of silicon, a transition metal and oxygen, the entire surface of the heat insulating layer is polished and many micro irregularities are formed on the entire polished surface of the heat insulating layer so that the entire polished surface sufficiently adheres to said plurality of heating elements, wherein said micro irregularities have a height of projection of about 10 to 30 nm.

2. The thermal head according to claim 1, wherein said etching produces said micro irregularities by selectively removing the silicon-oxygen bond portions scattered in the heat insulating layer.

3. The thermal head according to claim 1, wherein the polished insulating layer is etched such that said many micro irregularities are formed on the entire polished surface by said etching.

4. The thermal head according to claim 2, wherein the polished insulating layer is etched such that said many micro irregularities are formed on the entire polished surface by said etching.

5. The thermal head according to claim 1, wherein said micro irregularities have a diameter at the bottom thereof of about 0.2 to 0.3 $\mu$m.

6. The thermal head according to claim 2, wherein said micro irregularities have a diameter at the bottom thereof of about 0.2 to 0.3 $\mu$m.

7. The thermal head according to claim 3, wherein said micro irregularities have a diameter at the bottom thereof of about 0.2 to 0.3 $\mu$m.

8. The thermal head according to claim 1, wherein the number of said micro irregularities is 100 to 300 per 3.5 $\mu$m square over the entire surface of the heat insulating layer.

9. The thermal head according to claim 1, wherein said micro irregularities are formed over the entire surface of the heat insulating layer by polishing the entire surface of the heat insulating layer and then etching the entire surface.

10. The thermal head according to claim 1, wherein said plurality of heating elements is linearly arrayed on the surface of the heat insulating layer.

* * * * *